US005408838A

United States Patent [19]

Yaeger et al.

[11] Patent Number: 5,408,838

[45] Date of Patent: Apr. 25, 1995

[54] METHOD AND APPARATUS FOR CONDITIONING UNRECYCLED AMBIENT AIR

[75] Inventors: Ronald J. Yaeger; Gary D. Wolf, both of Dallas, Tex.

[73] Assignee: Air & Refrigeration Corp., Dallas, Tex.

[21] Appl. No.: 140,760

[22] Filed: Oct. 21, 1993

[51] Int. Cl.[6] ..... F25D 17/06

[52] U.S. Cl. ..... 62/92; 62/97; 62/122

[58] Field of Search ..... 62/91, 92, 96, 97, 122, 62/176.1, 176.6, 304; 165/3, 20, 103

[56] References Cited

U.S. PATENT DOCUMENTS

| | | | |
|---|---|---|---|
| 1,960,658 | 5/1934 | Brace | 62/176.1 |
| 2,144,693 | 1/1939 | Seid | 62/176.5 |
| 2,161,312 | 6/1939 | Pritchard | 62/97 |
| 2,165,831 | 7/1939 | Aulsebrook | 62/97 |
| 2,203,560 | 6/1940 | Ashley | 62/176.6 |
| 2,254,185 | 8/1941 | Newton | 165/20 |
| 4,362,026 | 12/1982 | Miller | 62/176.6 |
| 4,429,735 | 2/1984 | Nomaguchi et al. | 165/60 |
| 4,649,710 | 3/1987 | Inoue et al. | 62/92 |
| 4,940,475 | 7/1990 | Yaeger | 55/224 |
| 5,213,259 | 5/1993 | Stouffer | 236/44 C |

*Primary Examiner*—Henry A. Bennett
*Assistant Examiner*—William C. Doerrler
*Attorney, Agent, or Firm*—Richards, Medlock & Andrews

[57] ABSTRACT

A method and apparatus for conditioning the temperature and humidity of unrecycled ambient air within a certain climatic window of parameters to a desired point within a certain conditioned window of parameters is provided that comprise directing part of the ambient air through a cooling coil and humidifier connected in series and directing the other part of the ambient air through a bypass duct and recombining the bypass air with the conditioned air to create an air stream at the desired temperature and humidity. The air passing through the cooling coil and humidifier is overcooled and then brought to the desired condition upon combination with the bypass air.

18 Claims, 3 Drawing Sheets

FIG. 2
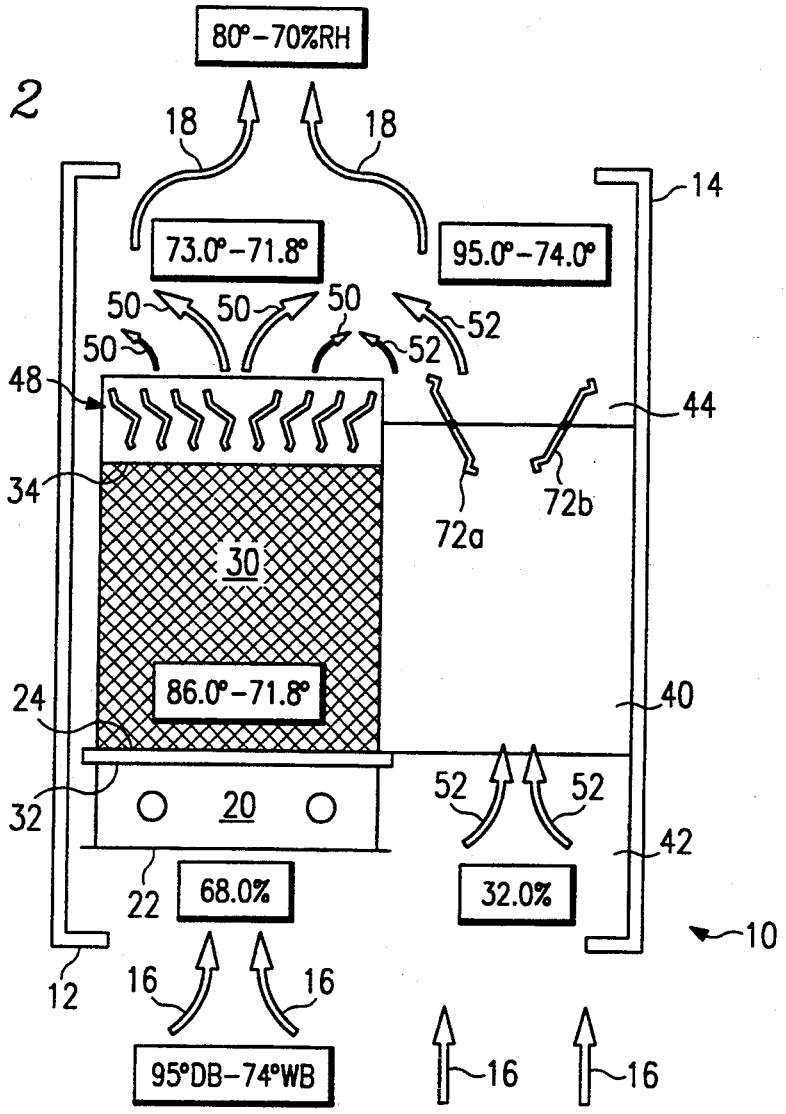
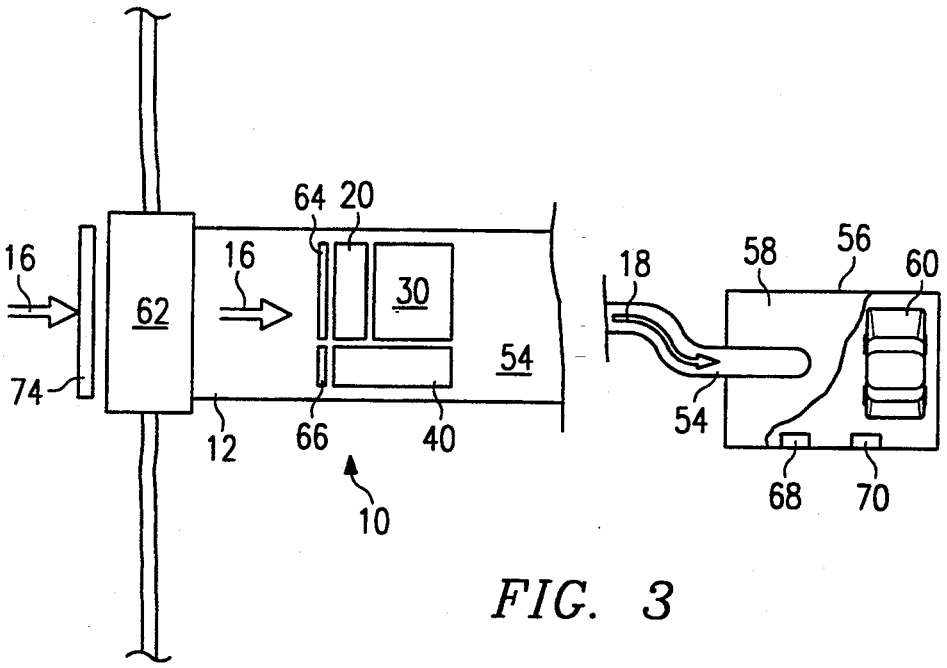
FIG. 3

METHOD AND APPARATUS FOR CONDITIONING UNRECYCLED AMBIENT AIR

TECHNICAL FIELD OF THE INVENTION

The present invention relates to a method and apparatus for conditioning the temperature and humidity of unrecycled ambient air without reheating. In particular, the present invention provides a method and apparatus for conditioning the temperature and the humidity of unrecycled ambient air to a desired temperature and humidity by overcooling one part of the ambient air and bypassing another part of the ambient air and recombining the two parts to create air at the desired temperature and humidity.

BACKGROUND OF THE INVENTION

Processes used in conditioning air from one state to another state vary widely depending on such factors as the qualities of the air to be conditioned, the temperature and humidity to which the air must be conditioned, the volume of air to be conditioned, and whether a portion of the conditioned air will be recirculated or whether 100% outside air will be used. Additionally, the qualities desired in the conditioned air vary. In some instances only the temperature of the air is important whereas in other instances the humidity of the air is more important.

The painting industry, and particularly the automobile painting industry, is one example of where the humidity as well as the temperature of the air must be maintained within an optimal range of conditions. Furthermore, in the painting industry the air is not recirculated due to harmful fumes, thus 100% outside air must be appropriately conditioned and supplied into the painting area at such a capacity to create a flow of air sufficient to remove fumes and paint overspray from the painting area. The automobile painting industry presently uses volatile organic compounds almost exclusively as solvents in its paints. The nature of solvent-based paints is such that the humidity of the air during painting is the most crucial condition that must be maintained within a specific range depending on the exact type of painting process. This creates a problem during the winter when the humidity of the outside air is below the range required for the painting process. To bring outside air during the winter into the desired range of humidity, an extensive process of heating and humidifying the outside air is performed to insure that the air will be within a predetermined range of humidity when introduced into the painting area. U.S. Pat. No. 4,940,475 to Yaeger discloses a particular type of humidifier used to humidify dry ambient air in applications such as this in the automobile painting industry. Because of the nature of solvent-based paints, precise control of the temperature of the outside air has not been a concern. Thus, conditioning of air in solvent-based painting applications has typically only been a concern during the low humidity months of winter.

However, the new development of using water-based paints in the automobile painting industry is creating new concerns about the condition of air during the summer months. The relatively new use of water-based paints is in response to environmental concerns. Water-based automobile paints have introduced an entirely new set of demands on the control of the condition of the air. Specifically, the temperature of the air, as well as the humidity, must be maintained within a specific range on a year round basis. These limits on the acceptable temperature and humidity now create a problem during the hot summer months when the outside air temperature is too high for water-based painting of automobiles. For example, one water-based painting application required the conditions of the air in the paint booth be maintained at 85° F.—72% RH (relative humidity) while the outside air conditions were 95° F.—38% RH in the summertime. The higher temperature of the outside air requires cooling, yet simultaneously the lower humidity ratio of the outside air necessitates humidification. Typically, the temperature and humidity conditions of the outside air change continuously during the day. This fact further complicates the conditioning process and its associated controls for painting applications using water-based paints.

Finned tube heat exchangers are used to heat or cool air being conditioned. A liquid refrigerant is passed through the tubes of the heat exchanger thus cooling the finned surface which is in direct contact with the air. The heat exchangers are arranged so that all conditioned air passes through the finned area. Usually, the air is cooled to a temperature below its dew point when water from the air condenses on the finned surface and runs off through a condensate collection and drainage arrangement. Thus, the air has been dehumidified as a result of being cooled. In the above-mentioned example of a paint booth set to operate at 85° F.—92% RH, cooling coils alone cannot provide the desired temperature and humidity.

Traditional conditioning processes approach the problem of cooling the summer outside air while achieving the desired level of humidity by overcooling the air to a point below the desired temperature and then sensibly reheating the air to the desired relative humidity. However, it can readily be seen that reheating the air that was just overcooled is inherently wasteful. A conditioning method which eliminates the step of reheating would achieve substantial economies in purchased equipment as well as operating efficiencies. Thus, a need exists for an air conditioning method by which outside air can be conditioned from a high temperature to a lower temperature without the need for reheating the overcooled air to maintain the desired humidity. Furthermore, such a method should be readily controllable and capable of handling high volumes encountered in new automobile painting factories.

Therefore, an object of the present invention is to provide a method and apparatus for efficiently conditioning ambient air from a high temperature to a lower temperature while simultaneously maintaining the desired level of humidity without the need for inefficient reheating.

SUMMARY OF THE INVENTION

The present invention provides a method and apparatus for conditioning unrecycled ambient air within a climatic window of 1) dry bulb temperature of at least 90° F., 2) enthalpy of at least 34.0 BTUs per pound of dry air, and 3) relative humidity greater than 30%, to a desired condition within a conditioned window of 1) enthalpy between about 30 BTUs and 40 BTUs per pound of dry air at standard conditions and 2) a relative humidity greater than 60%. In one aspect, a method is provided which comprises a first step of supplying an incoming stream of ambient air within the climatic window to a conditioning module with an upstream end and a downstream end. The conditioning module comprises a cooling coil with variable cooling capacity and a humidifier connected in series and a bypass duct placed parallel with the cooling coil and the humidifier. The next step is directing a first part of the ambient air through the cooling coil and the humidifier such that the first part becomes a cool air stream upon exiting the humidifier. The next step is directing a second part of the ambient air through the bypass duct to become a bypass air stream upon exiting the bypass duct that is not changed appreciably from the incoming stream. The next step is combining the cooled air stream and the bypass air stream to create a combined air stream in a downstream duct that extends from the downstream end of the conditioning module to the defined space such that the combined air stream is at a set point within the conditioned window.

A further aspect of the present invention is the steps of responding to the changes in the ambient air by altering the rate of air flow through either the cooling coil or the bypass duct or both such that the combined air stream in the downstream duct remains within the conditioned window. Preferably, the volumetric rate of air flow through the conditioning module remains constant by altering the rates of flow through the cooling coil and the bypass duct proportionally. The proportion of ambient air directed through the cooling coil with respect to the ambient air directed through the bypass duct is changed in response to changes in condition of the ambient air.

Another aspect of the present invention provides an apparatus for conditioning the air as described in the above method of the present invention. The present invention provides increased efficiencies over traditional conditioning methods because the present invention does not reheat any air in order to reach the conditioned window. On the other hand, only a portion of the incoming air stream is overcooled and the bypass portion of the air stream is then recombined with the overcooled air to arrive at a point within the conditioned window.

BRIEF DESCRIPTION OF THE DRAWINGS

FIG. 2 is a schematic of the conditioning module of the present invention.

FIG. 3 is a schematic of an automobile painting application using the method and apparatus of the present invention.

DETAILED DESCRIPTION

The present invention provides an efficient method and apparatus for conditioning 100% outside air with conditions of a dry bulb temperature of at least about 90° F., enthalpy of at least about 34 BTUs per pound of dry air, and relative humidity greater than about 30% (these parameters are hereinafter collectively referred to as the "climatic window") to a conditioned state where the enthalpy is between about 30 BTUs and about 40 BTUs per pound of dry air at standard conditions and the relative humidity is greater than about 60% (these parameters are hereinafter collectively referred to as the "conditioned window").

Figure 1:
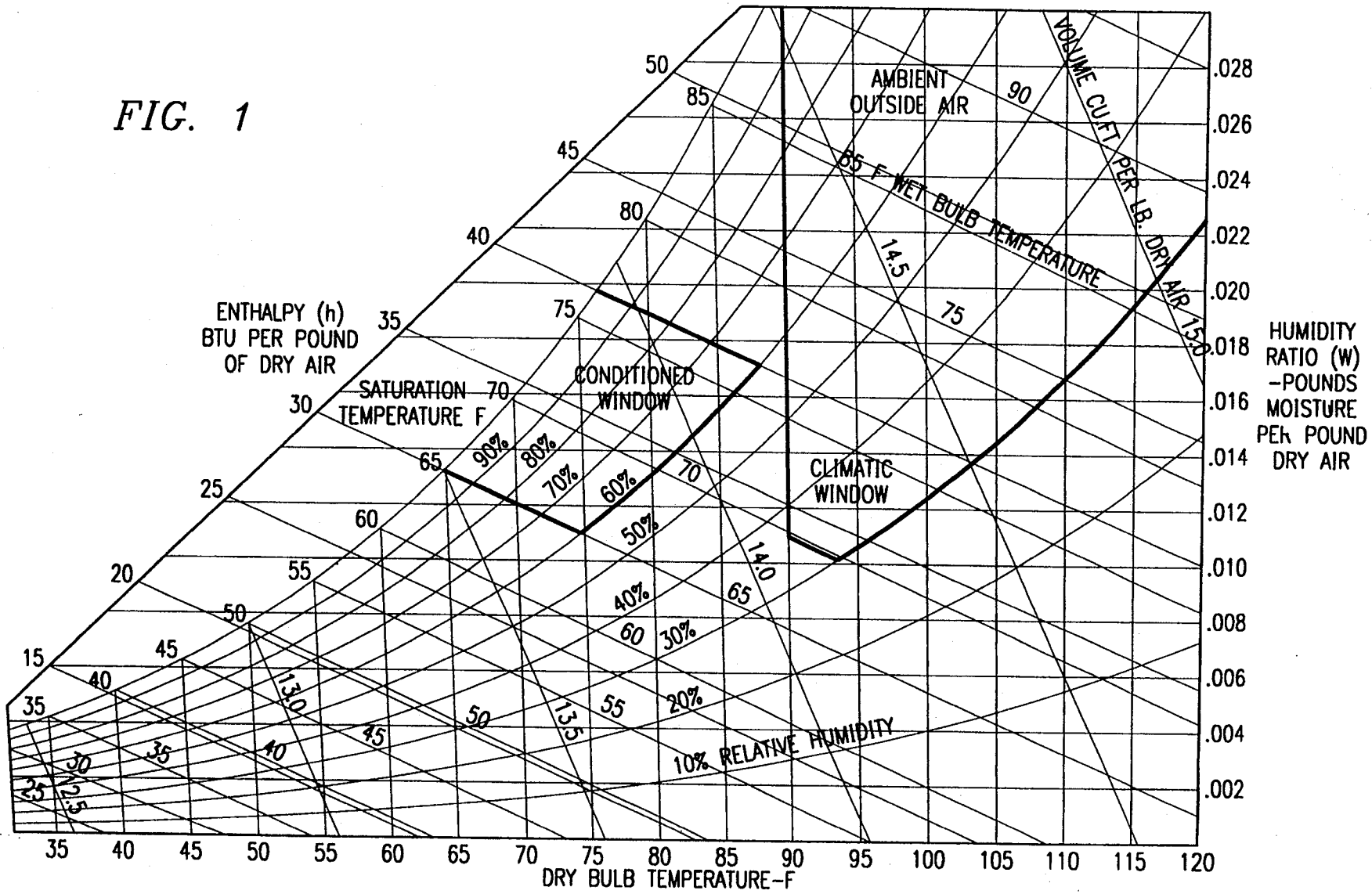
FIG. 1 is a psychrometric chart showing the climatic window and the conditioned window.

FIG. 1 is a simplified psychrometric chart illustrating the climatic window and the conditioned window. FIG. 1 is based on ASHRAE Psychrometric Chart No. 1. According to this chart, the range of temperatures within the conditioned window is from approximately 65° F. to approximately 88° F. The method and apparatus of the present invention are extremely useful for painting applications located where (1) the outside air temperature during the summer is within the climatic window, (2) the air within the painting area is required to be within a range of parameters that overlaps with the conditioned window, and (3) there is no recirculation of air. Specifically, the present invention conditions air from the climatic window to the conditioned window significantly more efficiently than the traditional method which includes reheating of the overcooled air.

In one aspect of the present invention, an apparatus is provided for conditioning air from any point in the climatic window to a desired point within the conditioned window without recirculating of the air or any reheating of such air. The apparatus comprises a cooling coil with variable cooling capacity and humidifier in parallel with a bypass duct. A portion of the incoming 100% outside air stream is routed through the cooling coil and humidifier and the remainder of the outside air is routed through the bypass duct. The cooled stream and the bypass stream then combine downstream of the exits of the cooling coil and bypass duct such that the combined air is within the conditioned window.

For purposes of the this specification and the claims the following abbreviations will be used:

WB—wet bulb temperature
DB—dry bulb temperature
When neither WB or DB is used after a temperature, the temperature refers to the dry bulb temperature
RH—relative humidity
All temperatures are in Fahrenheit

EXAMPLE

FIG. 2 illustrates an example of the present invention. A conditioning module 10 has upstream end 12 and downstream end 14. Incoming ambient air 16 is represented by arrows shown entering upstream end 12. Conditioned air 18 is represented by arrows shown exiting from downstream end 14. In this example, incoming ambient air 16 is at 95° DB and 74° WB. The desired state of conditioned air 18 is 80° DB at 70% RH.

Conditioning module 10 comprises cooling coil 20 with inlet 22 and outlet 24. Cooling coil 20 has a variable cooling capacity to respond to changes in incoming ambient air 16. Humidifier 30 is connected in series with cooling coil 20. Humidifier 30 has inlet 32 connected to outlet 24 of cooling coil 20, and outlet 34 downstream therefrom. Conditioning module 10 also comprises bypass duct 40 with first end 42 and second end 44. A flow control device, shown as dampers **72*a* and 72*b*, may be used with bypass duct 40 to control flow therethrough. Bypass duct 40 is in parallel with cooling coil 20 and humidifier 30**.

The desired state of conditioned air 18 at 80° DB, 70% RH is efficiently achieved in the present example by directing 68% of incoming ambient air 16 through cooling coil 20 where it is cooled to about 86° DB–71.8° WB as a result of the cooling and condensation that occurs in the cooling coil. This cooled air then travels through humidifier 30 where the air is adiabatically cooled until it exits outlet 34 at about 73° DB–71.8° WB. This air will be referred to as cooled air stream 50 represented by arrows exiting outlet 34 of humidifier 30. Meanwhile, 32% of incoming ambient air 16 is routed through bypass duct 40 where it exits second end 44 in substantially the same condition as it entered conditioning module 10. This air will be referred to as bypass air stream 52 represented by arrows entering and exiting bypass duct 40.

After cooled air stream 50 exits outlet 34 of humidifier 30 and bypass air stream 52 exits second end 44 of bypass duct 40, the two streams will mix together to form a combined air stream as the two streams continue downstream unseparated. As this air combines into a combined air stream, it becomes conditioned air 18. Mixing mechanisms such as vanes 48 may be used to facilitate the mixing of cooled air stream 50 and bypass air stream 52, but a significant length of downstream ducting or passage through a supply device located downstream should be sufficient for the two streams to sufficiently mix. The mixed air stream that results from the cooled air stream and the bypass air stream in this example will be at the desired condition of 80° DB—70% RH. The above example illustrates how the ambient air at 95° DB–74° WB must be divided between the cooled air stream and the bypass air stream to create a resulting mixed air stream of 80° DB—70% RH.

FIG. 3 shows a schematic of an automobile painting application using the present invention. Conditioning module 10 is shown in duct 54. Duct 54 runs to the defined space to be conditioned shown as paint booth 56. Duct 54 enters booth 56 at its roof 58. Roof 58 is cut away to show car 60 as an example of an item to be painted in booth 56. Upstream end 12 of duct 54 is in communication with ambient air supply device 62, for example, a fan which blows ambient air through conditioning module 10 and duct 54. As also shown in FIG. 2, conditioning module 10 comprises cooling coil 20, humidifier 30, and bypass duct 40. Supply device 62 can alternatively be placed downstream of conditioning module 10 and used to draw ambient air through conditioning module 10 and duct 54.

As the condition of incoming ambient air 16 changes, there are several ways for conditioning module 10 to adapt. For example, first flow control device 64, for example, dampers can be placed in series with cooling coil 20 and second flow control device 66, for example, dampers can be placed in series with bypass duct 40. By adjusting the proportion of cooled air to bypass air with one or both of the flow control devices, a range of incoming ambient air 16 conditions can be conditioned to the same desired state of conditioned air 18. An example of second flow control device 66 is shown in FIG. 2 as two dampers 72*a*, 72*b* that can be rotated to increase or decrease the area of flow.

Also, the temperature of cooling coil 20 may be adjusted in response to varying ambient air conditions. For example, temperature sensor 68 located in paint booth 56 can be used in a control loop to control the temperature of cooling coil 20 in response to temperature changes. Also, humidity sensor 70 located in paint booth 56 can be used in a control loop to control the amount of bypass air in response to humidity changes. Temperature sensor 68 can also be used to control preheat burner 74 during the winter which initially heats cold ambient air before the air enters conditioning module 10. The temperature of the air also changes as the percentage of bypass air varies. This causes the temperature control to change to a new condition which in turn causes a change in the relative humidity. Modern control systems have "anti-hunting" adjustments which can be used to eliminate such continuous interaction between two competing controls.

As bypass duct 40 is opened or closed by second flow control device 66 to control the conditioning process, the resistance to air flow changes. For example, if bypass duct 40 were fully opened, the air resistance would be at its minimum. This reduction in system resistance causes supply device 62, which is running at a constant RPM, to deliver more air. Thus, the air volume changes as bypass duct 40 varies in degrees of openness. This feature works well with modern energy-efficient control systems which maintain design conditions by varying air volume rather than temperature. Other applications, such as clean rooms, etc., may require constant air volume. For these applications, the present invention requires the addition of first flow control device 64 to control flow through cooling coil 20 and humidifier 30. With two flow control devices in parallel, the volumetric rate of air flow can be kept constant while varying the relative amounts of air passing through the cooling coil and bypass duct in inverse proportion. Alternatively, any resistance in bypass duct 40 could be kept constant and other parameters such as the temperature of cooling coil 20 or the rate of humidification of humidifier 30 or both could be varied.

Figure 4:
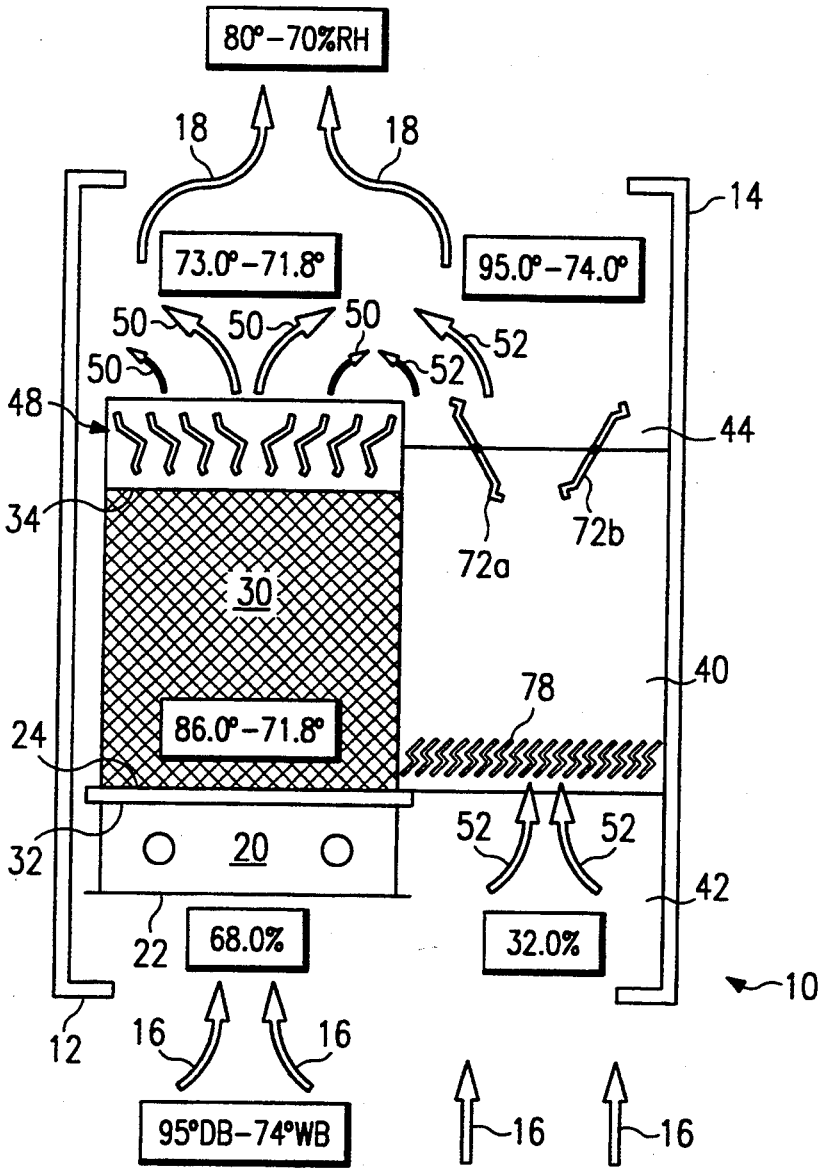
FIG. 4 is a schematic of an alternative embodiment of the conditioning module.

FIG. 4 shows an alternative embodiment where bypass duct 40 has a fixed air flow resistance element 78 which approximates the air flow resistance of the cooling coil and humidifier. As the proportion of the incoming stream of ambient air routed through the bypass duct increases, the higher the pressure drop across the resistance element and correspondingly, the lower the pressure drop across the cooling coil and humidifier as a result of the lower proportion of the incoming air being routed through the cooling coil and humidifier. In this way, the volumetric flow rate of the combined air stream in the downstream duct remains generally constant.

Cooling coil 20 is selected to have enough surface, i.e. rows of finned tubes, so that the temperature and humidity conditions of the air exiting cooling coil 20 are suitable for mixing with the bypassed air to result in the desired mixed air conditions. The capacity is variable to respond to changes in the ambient air conditions.

Humidifier 30 should have a high saturation efficiency. The preferred humidifier is a wetted media type having a large surface area in contact with the air stream being humidified. Typically, the evaporative media consists of a number of corrugated sheets, glued together in an opposed arrangement which allows for horizontal air flow and gravity flow of water in a downward vertical path.

Although the present invention has been described with respect to a preferred embodiment, various changes, substitutions and modifications of such may be suggested to one skilled in the art, and it is intended that the present invention encompass such changes, substitutions and modifications as fall within the scope of the appended claims.

It is claimed:

1. A method of conditioning uncirculated ambient air to a desired condition within a conditioned window comprising the steps of:

(a) supplying an incoming stream of uncirculated ambient air within a climatic window of 1) dry bulb temperature at least 90° F., 2) enthalpy of at least 34.0 BTUs per pound of dry air, and 3) relative humidity greater than 30%, to a conditioning module, the conditioning module comprising a cooling coil with variable cooling capacity and an evaporative humidifier connected in series and a bypass duct placed in parallel with the cooling coil and the humidifier;

(b) directing a first part of the uncirculated ambient air through the cooling coil and the evaporative humidifier such that the first part becomes a cooled air stream upon exiting the humidifier with a temperature and humidity lower than the conditioned window;

(c) directing a second part of the uncirculated ambient air through the bypass duct to become a bypass air stream upon exiting the bypass duct that has substantially the same condition as the incoming stream;

(d) combining the cooled air stream and the bypass air stream to create a combined air stream within the conditioned window of 1) enthalpy between 30.0 BTUs and 40.0 BTUs per pound of dry air at standard conditions and 2) a relative humidity greater than 60%, in a defined space, in a downstream duct extending from the downstream end of the conditioning module to the defined space;

(e) introducing to combined air stream into the defined space; and (f) exhausting the combined air stream from the defined space so the combined air stream is not recirculated to the conditioning module.

2. The method of claim 1 further comprising the step of altering the rate of flow of the ambient air through the bypass duct in response to a change in the temperature or humidity of the ambient air such that the combined air stream remains within the conditioned window.

3. The method of claim 1 further comprising the step of altering the rate of flow of the ambient air through the cooling coil and the humidifier in response to a change in the temperature or humidity of the ambient air such that the combined air stream remains within the conditioned window.

4. The method of claim 2 further comprising the step of providing a fixed air flow resistance element in the bypass duct which approximates the air flow resistance through the cooling coil and humidifier such that a change in the proportion of the incoming stream of ambient air flowing through the bypass duct will not appreciably change the volumetric rate of flow of the combined air stream through the downstream air duct.

5. The method of claim 3 further comprising the step of providing an air flow resistance element in the bypass duct which is set to approximate the air flow resistance through the cooling coil and humidifier.

6. The method of claim 3 wherein the step of altering the rate of flow of the ambient air through the cooling coil is achieved by simultaneously altering the rate of flow through the bypass duct and through the cooling coil in inverse proportion so as to maintain generally constant volumetric rate of flow of the combined air stream in the downstream duct.

7. The method of claim 1 further comprising the step of altering the rate of flow of the ambient air through the cooling coil and the humidifier and altering the rate of flow of the ambient air through the bypass duct in converse proportion in response to a change in conditions of the ambient air such that the volumetric rate of air flow through the downstream duct remains constant and such that the combined air stream remains within the conditioned window.

8. The method of claim 1 further comprising the steps of sensing the temperature of the air in the defined space and altering the temperature of the cooling coil in response to the temperature of the air in the defined space to maintain the combined air stream within the conditioned window.

9. An apparatus for conditioning uncirculated ambient air within a climatic window of 1) dry bulb temperature of at least 90° F., 2) enthalpy of at least 34.0 BTUs per pound of dry air and 3) relative humidity greater than 30%, to a conditioned window of 1) enthalpy between 30.0 BTUs and 40.0 BTUs per pound of dry air at standard conditions and 2) a relative humidity greater than 60%, in a defined space, the apparatus comprising:

(a) a cooling coil with variable cooling capacity and having an inlet and an outlet;

(b) an evaporative humidifier with an inlet in communication with the outlet of the cooling coil and an outlet downstream therefrom;

(c) a bypass duct located in parallel with the cooling coil and the evaporative humidifier, the bypass duct having a first end and a second end downstream therefrom;

(d) an air supply device adapted for moving an incoming stream of uncirculated ambient air through the cooling coil, the evaporative humidifier, and the bypass duct; and (e) a downstream duct with an upstream end in communication with the outlet of the evaporative humidifier and the second end of the bypass duct and a downstream end in communication with the defined space.

10. The apparatus of claim 9 further comprising a first flow control device mounted in series with the cooling coil which can be adjusted to alter the rate of air flow through the cooling coil and the humidifier.

11. The apparatus of claim 9 further comprising a second flow control device attached in series with the bypass duct which can be adjusted to alter the rate of air flow through the bypass duct.

12. The apparatus of claim 9 further comprising a first flow control device connected in series with the cooling coil and a second flow control device connected in series with the bypass duct, and at least one sensor located in the defined space for sensing the condition of the air in the defined space so that the first flow control device and second flow control device can be adjusted conversely in response to a change in the condition of the air in the defined space such that the volumetric flow rate of air through the downstream duct remains constant and such that the combined air stream remains within the conditioned window.

13. The apparatus of claim 9 further comprising a preheat burner for initially heating cold ambient air before it is directed through the bypass duct or the cooling coil.

14. The apparatus of claim 9 wherein the cooling coil is of the type with finned tubes.

15. The apparatus of claim 9 wherein the humidifier is of a wetted media type with evaporative media consisting of a number of corrugated sheets attached in an arrangement which allows for horizontal air flow and gravity flow of water.

16. The apparatus of claim 9 further comprising a fixed air flow resistance element in the bypass duct which approximates the air flow resistance through the cooling coil and humidifier such that a change in the proportion of the incoming stream of ambient air flowing through the bypass duct will not appreciably change the volumetric rate of air flow through the downstream duct.

17. A method of conditioning an incoming stream of uncirculated ambient air that is within a climatic window with the parameters of 1) dry bulb temperature of at least 90° F., 2) enthalpy of at least 34.0 BTUs per pound of dry air, and 3) relative humidity greater than 30%, to a conditioned window with the parameters of 1) enthalpy between 30.0 BTUs and 40.0 BTUs per pound of dry air at standard conditions and 2) a relative humidity greater than 60%, in a defined space, the method comprising the steps of:

(a) directing a first part of the uncirculated incoming stream through a cooling coil with variable cooling capacity and an evaporative humidifier such that the first part becomes a cooled air stream with a temperature and humidity lower than the conditioned window;

(b) directing a second part of the uncirculated incoming stream through a bypass duct to become a bypass air stream that remains in substantially the same condition as the incoming stream;

(c) combining the cooled air stream and the bypass air stream to create a combined air stream, the relative proportions of the air stream directed through the cooling coil and the bypass duct being such that the combined air stream is within the conditioned window; and (e) introducing to combined air stream into a defined space; and (f) exhausting the combined air stream from the defined space so that the combined air stream is not circulated to the conditioning module.

18. The method of claim 17 further comprising the step of altering the rate of flow of the ambient air through the cooling coil and the humidifier and altering the rate of flow of the ambient air through the bypass duct in converse proportion in response to a change in conditions of the ambient air such that the volumetric rate of air flow through the downstream duct remains constant and such that the combined air stream remains within the conditioned window.

* * * * *